US011408041B2

(12) United States Patent
Lee et al.

(10) Patent No.: US 11,408,041 B2
(45) Date of Patent: Aug. 9, 2022

(54) NON-ORIENTED ELECTRICAL STEEL SHEET AND METHOD FOR PRODUCING SAME

(71) Applicant: POSCO, Pohang-si (KR)

(72) Inventors: Hun Ju Lee, Pohang-si (KR); Yong-Soo Kim, Pohang-si (KR); Su-Yong Shin, Pohang-si (KR)

(73) Assignee: POSCO, Pohang-si (KR)

( * ) Notice: Subject to any disclaimer, the term of this patent is extended or adjusted under 35 U.S.C. 154(b) by 0 days.

(21) Appl. No.: 16/957,930

(22) PCT Filed: May 16, 2018

(86) PCT No.: PCT/KR2018/005623

§ 371 (c)(1),
(2) Date: Jun. 25, 2020

(87) PCT Pub. No.: WO2019/132129

PCT Pub. Date: Jul. 4, 2019

(65) Prior Publication Data

US 2021/0062281 A1 Mar. 4, 2021

(30) Foreign Application Priority Data

Dec. 26, 2017 (KR) ..... 10-2017-0179918

(51) Int. Cl.

| | |
|---|---|
| ***C21D 6/00*** | (2006.01) |
| ***C21D 8/12*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/60*** | (2006.01) |

(52) U.S. Cl.

CPC ..... *C21D 6/008* (2013.01); *C21D 8/1222* (2013.01); *C21D 8/1233* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/12* (2013.01); *C22C 38/14* (2013.01); *C22C 38/60* (2013.01)

(58) Field of Classification Search

None

See application file for complete search history.

(56) References Cited

U.S. PATENT DOCUMENTS

| | | | | |
|---|---|---|---|---|
| 2012/0014828 | A1 | 1/2012 | Miyazaki et al. | |
| 2015/0187475 | A1* | 7/2015 | Zaizen | C22C 38/04 148/309 |
| 2016/0322137 | A1 | 11/2016 | Lee et al. | |
| 2017/0194082 | A1* | 7/2017 | Murakami | C21D 9/46 |
| 2017/0362677 | A1 | 12/2017 | Kim et al. | |
| 2019/0017135 | A1* | 1/2019 | Lee | C21D 8/12 |

FOREIGN PATENT DOCUMENTS

| | | | | |
|---|---|---|---|---|
| EP | 2960352 | A1 | 12/2015 | |
| JP | H09-033394 | A | 2/1997 | |
| JP | 2004-328986 | A | 11/2004 | |
| JP | 2009-007592 | A | 1/2009 | |
| JP | 2009-299102 | A | 12/2009 | |
| JP | 4681689 | B2 | 5/2011 | |
| JP | 2014-162939 | A | 9/2014 | |
| KR | 10-2008-0027913 | A | 3/2008 | |
| KR | 10-2015-0119229 | A | 10/2015 | |
| KR | 10-1701194 | B1 | 2/2017 | |
| KR | 10-1728028 | B1 | 4/2017 | |
| KR | 10-2017-0072210 | A | 6/2017 | |
| WO | 2010/0140509 | A1 | 12/2010 | |
| WO | 2014/030512 | A1 | 2/2014 | |
| WO | 2016/063098 | A1 | 4/2016 | |
| WO | 2017/111548 | A8 | 6/2017 | |
| WO | WO-2017111548 | A1 * | 6/2017 | C22C 38/12 |
| WO | 2017/1155657 | A1 | 7/2017 | |

OTHER PUBLICATIONS

English machine translation of JP2009-007592, EPO, accessed Aug. 30, 2021.*

Extended European Search Report dated Sep. 29, 2020 issued in European Patent Application No. 18894273.4.

International Search Report dated Sep. 18, 2018 issued in International Patent Application No. PCT/KR2018/005623 (with English translation).

(Continued)

*Primary Examiner* — Xiaobei Wang

(74) *Attorney, Agent, or Firm* — Morgan, Lewis & Bockius LLP

(57) ABSTRACT

A non-oriented electrical steel sheet according to an exemplary embodiment of the present invention includes 2.0 to 4.0% of Si, 0.05 to 1.5% of Al, 0.05 to 2.5% of Mn, equal to or less than 0.005% of C (excluding 0%), equal to or less than 0.005% of N (excluding 0%), 0.001 to 0.1% of Sn, 0.001 to 0.1% of Sb, 0.001 to 0.1% of P, 0.001 to 0.01% of As, 0.0005 to 0.01% of Se, 0.0005 to 0.01% of Pb, 0.0005 to 0.01% of Bi, a remainder of Fe, and inevitable impurities, as wt %, wherein a Taylor factor (M) of each crystal grain included in a steel sheet is expressed in Formula 1, and an average Taylor factor value of the steel sheet is equal to or less than 2.75:

$$M = \frac{\sigma}{\tau_{CRSS}} \quad \text{[Formula 1]}$$

(here, σ is a macro stress, and $\tau_{CRSS}$ is a critical resolved shear stress).

7 Claims, No Drawings

(56) References Cited

OTHER PUBLICATIONS
Japanese Office Action dated Aug. 3, 2021 issued in Japanese Patent Application No. 2020-536266.

* cited by examiner

NON-ORIENTED ELECTRICAL STEEL SHEET AND METHOD FOR PRODUCING SAME

CROSS-REFERENCE OF RELATED APPLICATIONS

This application is the U.S. National Phase under 35 U.S.C. § 371 of International Patent Application No. PCT/KR2018/005623, filed on May 16, 2018, which in turn claims the benefit of Korean Application No. 10-2017-0179918, filed on Dec. 26, 2017, the entire disclosures of which applications are incorporated by reference herein.

BACKGROUND OF THE INVENTION

(a) Field of the Invention

The present disclosure relates to a non-oriented electrical steel sheet and a manufacturing method thereof. Particularly, it relates to a non-oriented electrical steel sheet for reducing a residual stress by reducing an average Taylor factor, and ultimately improving low-field magnetism by mutually controlling a content of microelements contained in a steel sheet, and a manufacturing method thereof.

(b) Description of the Related Art

A non-oriented electrical steel sheet is usually used in a motor for changing electrical energy into mechanical energy, during which it requires an excellent magnetic characteristic of the non-oriented electrical steel sheet so as to demonstrate high efficiency. Particularly, in recent years, as environment-friendly techniques are being paid attention, it is considered to be very important to increase efficiency of the motor accounting for half of use the electrical energy, and to achieve this, an excellent magnetic characteristic of the non-oriented electrical steel sheet is increasingly required.

The magnetic characteristic of the non-oriented electrical steel sheet is generally estimated based on iron loss and magnetic flux density. The iron loss represents an energy loss generated at a specific magnetic flux density and frequency, and the magnetic flux density indicates a degree of magnetization obtained in a specific magnetic field. The more iron loss lowers, the higher energy efficiency the motor may have in a same condition, and the higher magnetic flux density increases, the more the motor may be down-sized or the copper loss may be reduced, so it is important to manufacture the non-oriented electrical steel sheet with low iron loss and high magnetic flux density.

The characteristic of the non-oriented electrical steel sheet to be considered according to operational conditions of the motor is also changed. As a reference for determining the characteristic of the non-oriented electrical steel sheet used in the motors, many motors regard W15/50, which is iron loss when a magnetic field of 1.5 T is applied at a commercial frequency of 50 Hz, as the most important value. However, all motors used for various purposes do not value the iron loss of W15/50 as the most important, and they also estimate iron loss at other frequencies or applied magnetic fields according to a main operational condition. Particularly, from among the non-oriented electrical steel sheets recently used in motors for driving large generators or electric cars, there are many cases in which the magnetic characteristic is important in a low magnetic field of 1.0 T or less, so the characteristic of the non-oriented electrical steel sheet is estimated with a low-field iron loss such as W10/50 or W10/400.

A conventional method for increasing the magnetic characteristic of the non-oriented electrical steel sheet is adding an alloying element such as Si. Specific resistance of the steel may be increased by adding such an alloying element, and as specific resistance increases, an eddy current loss reduces to thus reduce the entire iron loss. On the contrary, as the content of Si increases, the magnetic flux density is deteriorated and brittleness increases, and when more than a predetermined amount thereof is added, it may not be cold rolled and may not be able to be commercially produced. Particularly, the electrical steel sheet may obtain the effect of reducing the iron loss as it becomes thinner, but the deterioration of rolling by the brittleness is a serious problem. To additionally increase specific resistance of the steel, a high-quality non-oriented electrical steel sheet with excellent magnetism may be manufactured by adding elements such as Al or Mn.

To reduce the low-field iron loss of the non-oriented electrical steel sheet, it is important to reduce the carbide or the nitride precipitated in the steel as well as the above-described specific resistance and thickness, and to reduce the stress remaining in the steel sheet. This is because, in the low field, a fluent movement of the magnetic domain wall substantially influences the iron loss, and the precipitates and the residual stress hinder the movement of the magnetic domain wall and worsens the low-field magnetism.

The residual stress may be produced by a tension applied by a continuous annealing line. When the non-oriented electrical steel sheet is finally annealed in the continuous line, a tension is unavoidably applied to a coil so as to prevent meandering, and a residual stress is generated on the steel sheet.

In another way, there have been no attempts to improve magnetism by appropriately controlling arsenic (As), selenium (Se), lead (Pb), and bismuth (Bi).

The above information disclosed in this Background section is only for enhancement of understanding of the background of the invention, and therefore it may contain information that does not form the prior art that is already known in this country to a person of ordinary skill in the art.

SUMMARY OF THE INVENTION

The present invention has been made in an effort to provide a non-oriented electrical steel sheet and a manufacturing method thereof.

In detail, the present invention has been made in an effort to provide a non-oriented electrical steel sheet for reducing a residual stress by reducing an average Taylor factor, and ultimately improving low-field magnetism by mutually controlling a content of microelements contained in a steel sheet, and a manufacturing method thereof.

An exemplary embodiment of the present invention provides a non-oriented electrical steel sheet including 2.0 to 4.0% of Si, 0.05 to 1.5% of Al, 0.05 to 2.5% of Mn, equal to or less than 0.005% of C (excluding 0%), equal to or less than 0.005% of N (excluding 0%), 0.001 to 0.1% of Sn, 0.001 to 0.1% of Sb, 0.001 to 0.1% of P, 0.001 to 0.01% of As, 0.0005 to 0.01% of Se, 0.0005 to 0.01% of Pb, 0.0005 to 0.01% of Bi, a remainder of Fe, and inevitable impurities, as wt %, wherein a Taylor factor (M) of each crystal grain included in a steel sheet is expressed in Formula 1, and an average Taylor factor value of the steel sheet is equal to or less than 2.75.

$$M = \frac{\sigma}{\tau_{crss}} \quad \text{[Formula 1]}$$

(Here, σ is a macro stress, and $\tau_{CRSS}$ is a critical resolved shear stress.)

The non-oriented electrical steel sheet may satisfy Formula 2 and Formula 3.

$$3\times([C]+[N])\leq([Sn]+[Sb]+[P]+[As]+[Se]+[Pb]+[Bi])\leq 15\times([C]+[N]), \text{ and} \quad \text{[Formula 2]}$$

$$([Sn]+[Sb])\geq[P]\geq([As]+[Se])\geq([Pb]+[Bi]) \quad \text{[Formula 3]}$$

(Here, [C], [N], [Sn], [Sb], [P], [As], [Se], [Pb], and [Bi] are contents (wt %) of C, N, Sn, Sb, P, As, Se, Pb, and Bi.)

The non-oriented electrical steel sheet may further include 0.0005 to 0.01 wt % of Nb, 0.0005 to 0.01 wt % of Ti, and 0.0005 to 0.01 wt % of V.

The non-oriented electrical steel sheet may satisfy Formula 4.

$$([Nb]+[Ti]+[V])\leq([C]+[N]) \quad \text{[Formula 4]}$$

(Here, [C], [N], [Nb], [Ti], and [V] are contents (wt %) of C, N, Nb, and V.)

The non-oriented electrical steel sheet may further include at least one of equal to or less than 0.005 wt % of S, equal to or less than 0.025 wt % of Cu, equal to or less than 0.002 wt % of B, equal to or less than 0.005 wt % of Mg, and equal to or less than 0.005 wt % of Zr.

The non-oriented electrical steel sheet may have an average crystal grain diameter of 60 to 170 μm.

Another embodiment of the present invention provides a method for manufacturing a non-oriented electrical steel sheet, including: manufacturing a slab including 2.0 to 4.0% of Si, 0.05 to 1.5% of Al, 0.05 to 2.5% of Mn, equal to or less than 0.005% of C (excluding 0%), equal to or less than 0.005% of N (excluding 0%), 0.001 to 0.1% of Sn, 0.001 to 0.1% of Sb, 0.001 to 0.1% of P, 0.001 to 0.01% of As, 0.0005 to 0.01% of Se, 0.0005 to 0.01% of Pb, 0.0005 to 0.01% of Bi, a remainder of Fe, and inevitable impurities, as wt %; heating the slab; manufacturing a hot-rolled steel sheet by hot rolling the slab; manufacturing a cold-rolled steel sheet by cold rolling the hot-rolled steel sheet; and finally annealing the cold-rolled steel sheet.

The slab may satisfy Formula 2 and Formula 3.

$$3\times([C]+[N])\leq([Sn]+[Sb]+[P]+[As]+[Se]+[Pb]+[Bi])\leq 15\times([C]+[N]), \text{ and} \quad \text{[Formula 2]}$$

$$([Sn]+[Sb])\geq[P]\geq([As]+[Se])\geq([Pb]+[Bi]) \quad \text{[Formula 3]}$$

(Here, [C], [N], [Sn], [Sb], [P], [As], [Se], [Pb], and [Bi] are contents (wt %) of C, N, Sn, Sb, P, As, Se, Pb, and Bi.)

The manufacturing method may further include, after the manufacturing of a hot-rolled steel sheet, performing hot-rolled steel sheet annealing on the hot-rolled steel sheet.

The non-oriented electrical steel sheet according to the exemplary embodiment of the present invention may remove the residual stress by controlling the Taylor factor to be low, and may ultimately improve the low-field magnetism.

Further, generation of the carbide and the nitride in the steel may be suppressed by controlling the respective contents of As, Se, Pb, and Bi that are microelements and the relative contents with C and N, and may ultimately improve the low-field magnetism.

Through this, environment-friendly motors for automobiles, high efficiency motors for home appliances, and super premium electric motors may be manufactured.

DETAILED DESCRIPTION OF THE EMBODIMENTS

It will be understood that, although the terms first, second, third, etc. may be used herein to describe various elements, components, regions, layers, and/or sections, they are not limited thereto. These terms are only used to distinguish one element, component, region, layer, or section from another element, component, region, layer, or section. Thus, a first element, component, region, layer, or section discussed below could be termed a second element, component, region, layer, or section without departing from the teachings of the present invention.

The technical terms used herein are to simply mention a particular exemplary embodiment and are not meant to limit the present invention. An expression used in the singular encompasses an expression of the plural, unless it has a clearly different meaning in the context. In the specification, it is to be understood that the terms such as "including", "having", etc., are intended to indicate the existence of specific features, regions, numbers, stages, operations, elements, components, or combinations thereof disclosed in the specification, and are not intended to preclude the possibility that one or more other specific features, regions, numbers, operations, elements, components, or combinations thereof may exist or may be added.

When a part is referred to as being "on" another part, it can be directly on the other part or intervening parts may also be present. In contrast, when an element is referred to as being "directly on" another element, there are no intervening elements therebetween.

Unless otherwise defined, all terms used herein, including technical or scientific terms, have the same meanings as those generally understood by those with ordinary knowledge in the field of art to which the present invention belongs. Such terms as those defined in a generally used dictionary are to be interpreted to have the meanings equal to the contextual meanings in the relevant field of art, and are not to be interpreted to have idealized or excessively formal meanings unless clearly defined in the present application.

Unless mentioned in a predetermined way, % represents wt %, and 1 ppm is 0.0001 wt %.

In an exemplary embodiment of the present invention, "further including an additional element" signifies including the additional element in substitute for iron (Fe) that is a remainder.

An exemplary embodiment of the present invention will be described more fully hereinafter so that a person skilled in the art may easily realize the same. As those skilled in the art would realize, the described embodiments may be modified in various different ways, all without departing from the spirit or scope of the present invention.

In an exemplary embodiment of the present invention, a residual stress is reduced by reducing an average Taylor factor.

The residual stress is generated by a tension applied by a continuous annealing line, or it is generated by unavoidably applying a tension to a coil so as to prevent meandering when final annealing is performed in the continuous line.

In this instance, when the same magnitude of tension is applied, intensity of the residual stress generated to the steel sheet may be different, and the intensity of the residual stress has a close relationship with the Taylor factor calculated from a crystallographic orientation of a material.

A steel material with a BCC crystal structure generates plastic deformation when three slip systems of {110}<111>, {123}<111>, and {112}<111> act, and the action performed by the slip system becomes different according to a deformation mode. A slip system action working on a specific crystallographic orientation in a specific deformation mode may be shown as a Taylor factor, which may be calculated according to Formula 1 when the Taylor factor is denoted as M.

$$M = \frac{\sigma}{\tau_{crss}} \quad \text{[Formula 1]}$$

(Here, σ is a macro stress, and $\tau_{CRSS}$ is a critical resolved shear stress.)

The greater the Taylor factor value is, the greater the residual stress is generated in the steel sheet when the same tension is applied. A one-axis extended deformation mode is generated in a coil proceeding direction in the continuous annealing line of the non-oriented electrical steel sheet, so the higher a fraction of the orientation having the Taylor factor becomes in the one-axis extension, the more the residual stress in the steel sheet increases. Therefore, the low-field iron loss may be substantially improved when the Taylor factor is calculated at the time of one-axis extension from the crystallographic orientation data with a sufficient area of the steel sheet and texture is developed so that an average value thereof may be low.

In detail, the average Taylor factor value may be calculated by measuring a cross-section (a TD side) in a transverse direction including an entire thickness of a specimen with an EBSD. In further detail, the Taylor factor may be calculated by measuring the area of (entire thickness)×5000 μm twenty times by applying a step gap of 2 μm so that they may not overlap each other, and combining the data. In this instance, the deformation mode represents a one-axis tension condition in the rolling direction, and the slip system may be found by applying the same value of CRSS to {110}<111>, {112}<111>, and {123}<111>.

The average Taylor factor ($\overline{M}$) represents an average value generated by dividing the sum of the Taylor factor values of respective measured points by a number of measured points. In an exemplary embodiment of the present invention, the average Taylor factor value is measured for each point in the EBSD for crystallographic orientation for an area including at least 5000 or more crystal grains, the sum of the Taylor factor values of the respective measured points is divided by the number of measured points to find an average value, and the average value is assumed to be the value of the entire measured area.

By controlling the average Taylor factor value to be less than 2.75, the residual stress may be removed, and the low-field magnetism may be ultimately improved. In detail, the average Taylor factor value may be reduced and the low-field magnetism may be improved by controlling the respective contents of As, Se, Pb, and Bi that are microelements and relative contents with C and N. In further detail, the average Taylor factor value may be 2.5 to 2.75.

The non-oriented electrical steel sheet according to an exemplary embodiment of the present invention includes 2.0 to 4.0% of Si, 0.05 to 1.5% of Al, 0.05 to 2.5% of Mn, equal to or less than 0.005% of C (excluding 0%), equal to or less than 0.005% of N (excluding 0%), 0.001 to 0.1% of Sn, 0.001 to 0.1% of Sb, 0.001 to 0.1% of P, 0.001 to 0.01% of As, 0.0005 to 0.01% of Se, 0.0005 to 0.01% of Pb, 0.0005 to 0.01% of Bi, a remainder of Fe, and inevitable impurities, with respect to wt %.

A reason of limiting a component of a non-oriented electrical steel sheet will now be described.

2.0 to 4.0 wt % of Si

The silicon (Si) increases specific resistance of a material to reduce iron loss, and when a very small amount thereof is added, an effect of improving iron loss may be insufficient. When a very large amount thereof is added, on the contrary, brittleness of the material may increase, and rolling productivity may be steeply deteriorated. Therefore, Si may be added in the above-noted range. In detail, 2.3 to 3.7 wt % of Si may be contained.

0.05 to 1.5 wt % of Al

The aluminum (Al) increases specific resistance of a material to reduce iron loss, and when a very small amount thereof is added, there is no effect in reducing the high-frequency iron loss, and a nitride is finely formed, so magnetism may be deteriorated. When a very large amount thereof is added, on the contrary, a substantial amount of the nitride is formed to deteriorate magnetism, and drawbacks may be generated in all processes such as steelmaking and continuous casting, thereby substantially deteriorating productivity. Therefore, Al may be added in the above-noted range. In detail, 0.1 to 1.3 wt % of Al may be contained.

0.05 to 2.5 wt % of Mn

The manganese (Mn) increases specific resistance of a material to improve the iron loss and form a sulfide, and when a very small amount thereof is added, a very small amount of sulfide may be precipitated to deteriorate magnetism. When a very large amount thereof is added, formation of the texture of {111} that is disadvantageous to magnetism may be promoted to reduce the magnetic flux density. Therefore, Mn may be added in the above-noted range. In detail, 0.1 to 1.5 wt % of Mn may be contained.

Equal to or Less than 0.005 wt % of C

The carbon (C) causes magnetic aging, and combines with other impurity elements to produce a carbide and deteriorate a magnetic characteristic, so it needs be limited to be equal to or less than 0.005 wt %, and in detail, equal to or less than 0.003 wt %.

Equal to or Less than 0.005 wt % of N

The nitrogen (N) forms fine and long AlN precipitates in a base material, and it also combines with other impurities to form a fine nitride, suppress growth of crystal grains, and deteriorate the iron loss, so it needs be limited to be equal to or less than 0.005 wt %, in detail, equal to or less than 0.003 wt %.

0.001 to 0.1 wt % of Sn

The tin (Sn) improves texture of a material and suppresses surface oxidation, so it may be added so as to improve the magnetism. When a very small amount of Sn is added, the effect may be vague. When a very large amount of Sn is added, segregation of a grain boundary may increase to thus deteriorate surface quality, and increase rigidity and accordingly break a cold-rolled steel sheet. Therefore, Sn may be added in the above-noted range. In detail, 0.002 to 0.05 wt % of Sn may be contained.

0.001 to 0.1 wt % of Sb

The antimony (Sb) improves texture of a material and suppresses surface oxidation, so it may be added so as to improve the magnetism. When a very small amount of Sb is added, the effect may be vague. When a very large amount of Sb is added, segregation of a grain boundary may increase to thus deteriorate surface quality, and increase rigidity and accordingly break a cold-rolled steel sheet. Therefore, Sb may be added in the above-noted range. In detail, 0.002 to 0.05 wt % of Sb may be contained.

0.001 to 0.1 wt % of P

The phosphorus (P) increases specific resistance of a material, and segregates a boundary to improve texture and increase magnetism. When a very small amount of phosphorus (P) is added, the segregated amount is very much less, and there may be no texture improving effect. When a very large amount of phosphorus (P) is added, formation of texture that is disadvantageous to magnetism may be generated, so there may be no texture improving effect, severe segregation to the boundary may be generated, the rolling property may be deteriorated, and its production may be difficult. Therefore, P may be added in the above-noted range. In detail, 0.003 to 0.05 wt % of P may be contained.

0.001 to 0.01 wt % of As, 0.0005 to 0.01 wt % of Se, 0.0005 to 0.01 wt % of Pb, and 0.0005 to 0.01 wt % of Bi The arsenic (As), selenium (Se), lead (Pb), and bismuth (Bi) are segregated on a surface of a base material or a grain boundary to lower surface energy and boundary energy, accordingly suppress formation of an oxidation layer and precipitates, and develop texture that is advantageous to magnetism. When the respective contents are very much less, an expression of the effect thereof may be insufficient. When there are too much of the respective contents, fine precipitates may be formed or segregation to the grain boundary may be generated to reduce a bonding force between crystal grains in the steel. Therefore, As, Se, Pb, and Bi may be contained in the above-noted range. In detail, 0.002 to 0.007 wt % of As, 0.001 to 0.005 wt % of Se, 0.001 to 0.005 wt % of Pb, and 0.001 to 0.005 wt % of Bi may be contained.

The non-oriented electrical steel sheet according to an exemplary embodiment of the present invention satisfies Formula 2 and Formula 3.

$$3\times([C]+[N])\leq([Sn]+[Sb]+[P]+[As]+[Se]+[Pb]+[Bi])\leq 15\times([C]+[N]),\text{ and} \quad \text{[Formula 2]}$$

$$([Sn]+[Sb])\geq[P]\geq([As]+[Se])\geq([Pb]+[Bi]) \quad \text{[Formula 3]}$$

(Here, [C], [N], [Sn], [Sb], [P], [As], [Se], [Pb], and [Bi] are contents (wt %) of C, N, Sn, Sb, P, As, Se, Pb, and Bi.)

The Sn, Sb, P, As, Se, Pb, and Bi is segregated to the surface of the base material or the grain boundary to reduce surface energy and boundary energy, accordingly suppress formation of the oxidation layer and the precipitates, and develop texture that is advantageous to magnetism. When the content sum of the above-noted elements is 3 to 15 times the content sum of C and N, formation of a carbide and a nitride is suppressed, orientation with a low Taylor factor is developed, and the low-field iron loss may be improved. Particularly, when Formula 3 is simultaneously satisfied, the above-noted effect may be further increased.

The non-oriented electrical steel sheet according to an exemplary embodiment of the present invention may further include 0.0005 to 0.01 wt % of Nb, 0.0005 to 0.01 wt % of Ti, and 0.0005 to 0.01 wt % of V.

0.0005 to 0.01 wt % of Nb, 0.0005 to 0.01 wt % of Ti, and 0.0005 to 0.01 wt % of V The niobium (Nb), titanium (Ti), and vanadium (V) have a very strong precipitate formation trend in the steel, and they deteriorate the iron loss by forming a fine carbide or nitride inside the base material and suppressing growth of crystal grains. Therefore, Nb, Ti, and V may further be respectively contained in the above-noted range. In detail, 0.001 to 0.005 wt % of Nb, 0.001 to 0.005 wt % of Ti, and 0.001 to 0.005 wt % of V may be contained. The non-oriented electrical steel sheet according to an exemplary embodiment of the present invention may satisfy Formula 4.

$$([Nb]+[Ti]+[V])\leq([C]+[N]) \quad \text{[Formula 4]}$$

(Here, [C], [N], [Nb], [Ti], and [V] represent the contents (wt %) of C, N, Nb, and V.)

When the summed content of Nb, Ti, and V is added at less than the summed content of C and N, the formation trend of the carbide and the nitride is weakened, thereby obtaining the low-field magnetism improving effect caused by an addition of Nb, Ti, and V.

Other Impurities

Inevitable impurities such as S, Cu, B, Mg, or Zr may be contained in addition to the above-described elements. The elements are traces, but may cause deterioration of magnetism by formation of inclusions in the steel, so S may be controlled to be equal to or less than 0.005 wt %, Cu may be controlled to be equal to or less than 0.025 wt %, B may be controlled to be equal to or less than 0.002 wt %, Mg may be controlled to be equal to or less than 0.005 wt %, and Zr may be controlled to be equal to or less than 0.005 wt %.

An average crystal grain size of the non-oriented electrical steel sheet according to an exemplary embodiment of the present invention may be 60 to 170 μm. In the above-noted range, the non-oriented electrical steel sheet has further excellent magnetism.

The non-oriented electrical steel sheet according to an exemplary embodiment of the present invention may have the thickness of 0.1 to 0.65 mm.

As described above, the non-oriented electrical steel sheet according to an exemplary embodiment of the present invention improves the low magnetic field characteristic. In detail, the magnetic flux density of B50 induced by the magnetic field of 5000 A/m is equal to or greater than 1.66 T. With respect to the thickness of 0.50 mm, the iron loss of W10/50 when the magnetic flux density of 1.0 T is induced at the frequency of 50 Hz may be equal to or less than 0.95 W/kg, and the iron loss of W10/400 when the magnetic flux density of 1.0 T is induced at the frequency of 400 Hz may be equal to or less than 24 W/kg. With respect to the thickness of 0.25 mm, the iron loss W10/50 when the magnetic flux density of 1.0 T is induced at the frequency of 50 Hz may be equal to or less than 0.80 W/kg, and the iron loss of W10/400 when the magnetic flux density of 1.0 T is induced at the frequency of 400 Hz may be equal to or less than 12 W/kg.

As described above, the non-oriented electrical steel sheet according to an exemplary embodiment of the present invention has an excellent low-field characteristic, so it may be well used in a generator that highly requires a magnetic characteristic in the low field and a motor for driving an electric car.

The method for manufacturing a non-oriented electrical steel sheet according to an exemplary embodiment of the present invention includes: manufacturing a slab including 2.0 to 4.0% of Si, 0.05 to 1.5% of Al, 0.05 to 2.5% of Mn, equal to or less than 0.005% of C (excluding 0%), equal to or less than 0.005% of N (excluding 0%), 0.001 to 0.1 wt % of Sn, 0.001 to 0.1% of Sb, 0.001 to 0.1 wt % of P, 0.001 to 0.01% of As, 0.0005 to 0.01% of Se, 0.0005 to 0.01% of Pb, 0.0005 to 0.01% of Bi, a remainder of Fe, and inevitable impurities, as wt %; heating the slab; manufacturing a hot-rolled steel sheet by hot rolling the slab; manufacturing a cold-rolled steel sheet by cold rolling the hot-rolled steel sheet; and finally annealing the cold-rolled steel sheet.

The respective steps will now be described in detail.

First, the slab is manufactured. The reasons for limiting the added ratios of the compositions in the slab correspond to the previously-described reasons for limiting the compositions of the non-oriented electrical steel sheet, so no repeated descriptions will be provided. In the manufacturing process including hot rolling, hot-rolled steel sheet annealing, cold rolling, and final annealing to be described, the compositions of the slab are not substantially changed, so the compositions of the slab substantially correspond to the compositions of the non-oriented electrical steel sheet.

First, the slab is heated. In detail, the slab is charged into a heating furnace and is heated at 1100 to 1250° C. When heated at more than the temperature of 1250° C., precipitates may be re-melted, they may be hot rolled, and they may be finely precipitated.

The heated slab is hot rolled to 1.0 to 2.3 mm to be manufactured as a hot-rolled steel sheet. In the manufacturing of a hot-rolled steel sheet, a finishing rolling temperature may be 800 to 1000° C.

After the manufacturing of a hot-rolled steel sheet, annealing the hot-rolled steel sheet may be further included. In this instance, the hot-rolled steel sheet annealing temperature may be 850 to 1150° C. When the hot-rolled steel sheet annealing temperature is less than 850° C., texture may not grow or may grow finely, so a rising effect of magnetic flux density is less, and when the annealing temperature is greater than 1150° C., the magnetic characteristic is deteriorated, and rolling workability may be worse because of deformation of the plate shape. In detail, the temperature range may be 950 to 1125° C. In detail, the annealing temperature of the hot-rolled steel sheet may be 900 to 1100° C. The hot-rolled steel sheet annealing is performed, if needed, so as to increase the orientation that is advantageous to magnetism, and it may also be omitted.

The hot-rolled steel sheet is pickled and is cold rolled so that it may have a predetermined plate thickness. It may be differently applied depending on the thickness of the hot-rolled steel sheet, but it may be cold rolled by applying a reduction ratio of 70 to 95% so that the final thickness may be 0.2 to 0.65 mm.

The cold-rolled steel sheet that is finally cold rolled undergoes final annealing so that the average crystal grain size may be 60 to 170 μm. The final annealing temperature may be 850 to 1050° C. When the final annealing temperature is very low, recrystallization may be insufficiently generated, and when the final annealing temperature is very high, the crystal grains rapidly grow, so the magnetic flux density and the high-frequency iron loss may be deteriorated. In detail, it may be finally annealed at the temperature of 900 to 1000° C. In the final annealing process, the texture formed in the previous cold rolling step may be entirely (i.e., 99% or more) recrystallized.

The following examples and comparative examples illustrate the present invention in more detail. However, the examples are an exemplary embodiment of the present invention, and the present invention is not limited to the same.

EXAMPLES

A slab composited as expressed in Table 1 and Table 2 is manufactured. The slab is heated at 1150° C., and it is then hot rolled at the finishing temperature of 880° C. to thus manufacture a hot-rolled steel sheet that is 2.0 mm thick. The hot-rolled steel sheet having undergone a hot rolling process undergoes a hot-rolled steel sheet annealing process for 100 seconds at 1030° C., it is then pickled and cold rolled so that it may be between 0.25 mm thick and 0.50 mm thick, and it is recrystallization annealed for 110 seconds at 1000° C.

Whether satisfying Formula 2, Formula 3, and Formula 4 or not, average Taylor factors, average crystal grain diameters, iron loss of W10/50, iron loss of W10/400, and magnetic flux density of B50 are expressed in Table 3. Regarding the magnetic characteristics such as the magnetic flux density or the iron loss, for each specimen, the specimen of 60 mm (width)×60 mm (length)×5 (number of pieces) is incised and is measured in the rolling direction and the transverse direction with a single sheet tester to find an average value. In this instance, W10/400 represents an iron loss when the magnetic flux density of 1.0 T is induced at the frequency of 400 Hz, W10/50 indicates an iron loss when the magnetic flux density of 1.0 T is induced at the frequency of 50 Hz, and B50 is the magnetic flux density induced in the magnetic field of 5000 A/m.

The Taylor factor is calculated by measuring the cross-section (TD side) in the transverse direction including the entire thickness of the specimen with an EBSD, and in detail, the area of 250 μm×5000 μm or 500 μm×5000 μm (at least about 1000 crystal grains or more) is measured twenty times by applying a step gap of 2 μm so that they may not overlap each other, and the data are combined to calculate the average Taylor factor. In this instance, the deformation mode represents a one-axis extending condition in the rolling direction, and the slip system applies the same value of CRSS to {110}<111>, {112}<111>, and {123}<111>.

TABLE 1

| Specimen numbers | Si (%) | Al (%) | Mn (%) | C (ppm) | N (ppm) | Sn (ppm) | Sb (ppm) | P (ppm) |
|---|---|---|---|---|---|---|---|---|
| A1 | 2.6 | 1.5 | 0.9 | 32 | 21 | 290 | 320 | 180 |
| A2 | 2.6 | 1.5 | 0.9 | 38 | 18 | 36 | 56 | 65 |
| A3 | 2.6 | 1.5 | 0.9 | 38 | 24 | 480 | 50 | 280 |
| A4 | 2.6 | 1.5 | 0.9 | 35 | 23 | 41 | 36 | 52 |
| B1 | 3.1 | 0.2 | 1.4 | 26 | 37 | 22 | 32 | 46 |
| B2 | 3.1 | 0.2 | 1.4 | 43 | 33 | 580 | 360 | 310 |
| B3 | 3.1 | 0.2 | 1.4 | 41 | 21 | 110 | 60 | 120 |
| B4 | 3.1 | 0.2 | 1.4 | 39 | 29 | 160 | 380 | 280 |
| C1 | 3.4 | 0.9 | 0.6 | 32 | 41 | 22 | 30 | 39 |
| C2 | 3.4 | 0.9 | 0.6 | 25 | 38 | 370 | 450 | 190 |
| C3 | 3.4 | 0.9 | 0.6 | 23 | 42 | 120 | 80 | 130 |
| C4 | 3.4 | 0.9 | 0.6 | 26 | 41 | 190 | 50 | 210 |
| D1 | 3.6 | 1 | 0.2 | 41 | 32 | 31 | 29 | 43 |
| D2 | 3.6 | 1 | 0.2 | 37 | 33 | 450 | 430 | 210 |
| D3 | 3.6 | 1 | 0.2 | 46 | 28 | 280 | 280 | 210 |
| D4 | 3.6 | 1 | 0.2 | 42 | 25 | 260 | 410 | 190 |
| D5 | 3.6 | 1 | 0.2 | 38 | 24 | 110 | 70 | 340 |
| D6 | 3.6 | 1 | 0.2 | 37 | 21 | 310 | 90 | 39 |
| D7 | 3.6 | 1 | 0.2 | 43 | 35 | 130 | 350 | 140 |
| D8 | 3.6 | 1 | 0.2 | 36 | 32 | 110 | 310 | 150 |

TABLE 2

| Specimen numbers | As (ppm) | Se (ppm) | Pb (ppm) | Bi (ppm) | Nb (ppm) | Ti (ppm) | V (ppm) |
|---|---|---|---|---|---|---|---|
| A1 | 31 | 14 | 15 | 13 | 39 | 27 | 24 |
| A2 | 24 | 12 | 14 | 13 | 25 | 28 | 33 |
| A3 | 41 | 23 | 22 | 18 | 16 | 17 | 11 |
| A4 | 26 | 11 | 15 | 14 | 14 | 22 | 22 |
| B1 | 27 | 10 | 16 | 15 | 21 | 14 | 21 |
| B2 | 49 | 31 | 22 | 27 | 23 | 16 | 25 |
| B3 | 44 | 31 | 21 | 28 | 18 | 13 | 26 |

TABLE 2-continued

| Specimen numbers | As (ppm) | Se (ppm) | Pb (ppm) | Bi (ppm) | Nb (ppm) | Ti (ppm) | V (ppm) |
|---|---|---|---|---|---|---|---|
| B4 | 53 | 22 | 11 | 22 | 25 | 16 | 24 |
| C1 | 27 | 8 | 9 | 7 | 14 | 13 | 18 |
| C2 | 39 | 30 | 17 | 17 | 11 | 14 | 11 |
| C3 | 37 | 32 | 13 | 18 | 15 | 11 | 12 |
| C4 | 51 | 22 | 29 | 16 | 15 | 10 | 15 |
| D1 | 24 | 9 | 12 | 11 | 43 | 27 | 31 |
| D2 | 54 | 26 | 22 | 22 | 28 | 45 | 26 |
| D3 | 34 | 30 | 17 | 21 | 24 | 19 | 21 |
| D4 | 33 | 24 | 16 | 19 | 19 | 23 | 23 |
| D5 | 32 | 11 | 14 | 13 | 17 | 24 | 16 |
| D6 | 34 | 29 | 14 | 16 | 25 | 16 | 24 |
| D7 | 24 | 13 | 28 | 50 | 17 | 27 | 26 |
| D8 | 28 | 21 | 16 | 14 | 19 | 20 | 21 |

TABLE 3

| Specimen numbers | Satisfies Formula 2 or not | Satisfies Formula 3 or not | Satisfies Formula 4 or not | Average Taylor factor | Average crystal grain diameter (μm) | Thickness (mm) | W10/50 (W/kg) | W10/400 (W/kg) | B50 (T) | Remarks |
|---|---|---|---|---|---|---|---|---|---|---|
| A1 | X | ○ | X | 2.79 | 49 | 0.5 | 0.99 | 24.5 | 1.65 | Comparative Example |
| A2 | ○ | ○ | X | 2.62 | 51 | | 0.96 | 23.6 | 1.64 | Example |
| A3 | ○ | ○ | ○ | 2.61 | 92 | | 0.91 | 23.3 | 1.68 | Example |
| A4 | ○ | ○ | ○ | 2.6 | 83 | | 0.92 | 23.2 | 1.68 | Example |
| B1 | X | ○ | ○ | 2.81 | 143 | | 1.09 | 25.7 | 1.64 | Comparative Example |
| B2 | X | ○ | ○ | 2.8 | 131 | | 1.1 | 25.2 | 1.65 | Comparative Example |
| B3 | ○ | ○ | ○ | 2.64 | 153 | | 0.91 | 23.1 | 1.69 | Example |
| B4 | ○ | ○ | ○ | 2.63 | 160 | | 0.9 | 23.3 | 1.68 | Example |
| C1 | X | ○ | ○ | 2.78 | 124 | | 1.09 | 25.6 | 1.64 | Comparative Example |
| C2 | X | ○ | ○ | 2.8 | 111 | | 1.12 | 25.4 | 1.64 | Comparative Example |
| C3 | ○ | ○ | ○ | 2.63 | 123 | | 0.92 | 23.4 | 1.69 | Example |
| C4 | ○ | ○ | ○ | 2.65 | 138 | | 0.92 | 23 | 1.68 | Example |
| D1 | X | ○ | X | 2.81 | 52 | 0.25 | 0.88 | 12.9 | 1.63 | Comparative Example |
| D2 | X | ○ | X | 2.79 | 47 | | 0.87 | 13.1 | 1.64 | Comparative Example |
| D3 | ○ | ○ | ○ | 2.63 | 89 | | 0.71 | 11.3 | 1.67 | Example |
| D4 | ○ | ○ | ○ | 2.67 | 96 | | 0.72 | 11.2 | 1.67 | Example |
| D5 | ○ | X | ○ | 2.79 | 101 | | 0.83 | 12.6 | 1.64 | Comparative Example |
| D6 | ○ | X | X | 2.81 | 92 | | 0.85 | 12.6 | 1.64 | Comparative Example |
| D7 | ○ | X | ○ | 2.82 | 89 | | 0.81 | 12.5 | 1.63 | Comparative Example |
| D8 | ○ | ○ | ○ | 2.68 | 108 | | 0.7 | 11.3 | 1.67 | Example |

As expressed in Table 1 to Table 3, in the case of the steel grade according to the example, the Taylor factor is reduced, and Formula 2 and Formula 3 are satisfied, so the low-field iron losses of W10/50 and W10/400 and the magnetic flux density value of B50 are shown to be excellent. On the contrary, the steel grade according to the comparative example has the Taylor factor that is greater than the reference and fails to satisfy Formula 2 and Formula 3, so it is found that the low-field iron losses of W10/50 and W10/400 and the magnetic flux density value of B50 are bad.

From among the steel grades according to the example, compared to the steel grade of A2 that fails to satisfy Formula 4 and has small crystal grain diameters, the steel grade that satisfies Formula 4 and has appropriate crystal grain diameters has excellent low-field iron losses W10/50 and W10/400 and the magnetic flux density value of B50.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims. Therefore, the embodiments described above are only examples and should not be construed as being limitative in any respects.

What is claimed is:

1. A non-oriented electrical steel sheet comprising 2.0 to 4.0% of Si, 0.05 to 1.5% of Al, 0.05 to 2.5% of Mn, equal to or less than 0.005% of C (excluding 0%), equal to or less than 0.005% of N (excluding 0%), 0.001 to 0.1% of Sn, 0.001 to 0.1% of Sb, 0.001 to 0.1% of P, 0.001 to 0.01% of As, 0.0005 to 0.01% of Se, 0.0005 to 0.01% of Pb, 0.0005 to 0.01% of Bi, a remainder of Fe, and inevitable impurities, as wt %, wherein a Taylor factor (M) of each crystal grain included in a steel sheet is expressed in Formula 1, and an average Taylor factor value of the steel sheet is equal to or less than 2.75;

$$M = \frac{\sigma}{\tau_{crss}} \quad \text{[Formula 1]}$$

here, σ is a macro stress, and $\tau_{CRSS}$ is a critical resolved shear stress, and wherein the steel sheet satisfies Formula 2 and Formula 3:

$$3\times([C]+[N])\leq([Sn]+[Sb]+[P]+[As]+[Se]+[Pb]+[Bi])\leq 15\times([C]+[N]) \quad \text{[Formula 2]}$$

$$([Sn]+[Sb])\geq[P]\geq([As]+[Se])\geq([Pb]+[Bi]) \quad \text{[Formula 3]}$$

here, [C], [N], [Sn], [Sb], [P], [As], [Se], [Pb], and [Bi] are contents (wt %) of C, N, Sn, Sb, P, As, Se, Pb, and Bi.

2. The non-oriented electrical steel sheet of claim 1, further comprising 0.0005 to 0.01 wt % of Nb, 0.0005 to 0.01 wt % of Ti, and 0.0005 to 0.01 wt % of V.

3. The non-oriented electrical steel sheet of claim 2, wherein Formula 4 is satisfied:

$$([Nb]+[Ti]+[V])\leq([C]+[N]) \quad \text{[Formula 4]}$$

(here, [C], [N], [Nb], [Ti], and [V] are contents (wt %) of C, N, Nb, and V).

4. The non-oriented electrical steel sheet of claim 1, further comprising at least one of equal to or less than 0.005 wt % of S, equal to or less than 0.025 wt % of Cu, equal to or less than 0.002 wt % of B, equal to or less than 0.005 wt % of Mg, and equal to or less than 0.005 wt % of Zr.

5. The non-oriented electrical steel sheet of claim 1, wherein an average crystal grain diameter is 60 to 170 μm.

6. A method for manufacturing a non-oriented electrical steel sheet, comprising:

manufacturing a slab including 2.0 to 4.0% of Si, 0.05 to 1.5% of Al, 0.05 to 2.5% of Mn, equal to or less than 0.005% of C (excluding 0%), equal to or less than 0.005% of N (excluding 0%), 0.001 to 0.1% of Sn, 0.001 to 0.1% of Sb, 0.001 to 0.1% of P, 0.001 to 0.01% of As, 0.0005 to 0.01% of Se, 0.0005 to 0.01% of Pb, 0.0005 to 0.01% of Bi, a remainder of Fe, and inevitable impurities, as wt %;

heating the slab;

manufacturing a hot-rolled steel sheet by hot rolling the slab;

manufacturing a cold-rolled steel sheet by cold rolling the hot-rolled steel sheet; and final annealing the cold-rolled steel sheet, wherein a Taylor factor (M) of each crystal grain included in the steel sheet is expressed in Formula 1, and an average Taylor factor value of the steel sheet is equal to or less than 2.75;

$$M = \frac{\sigma}{\tau_{crss}} \quad \text{Formula 1}$$

here, σ is a macro stress, and $\tau_{CRSS}$ is a critical resolved shear stress, and wherein the slab satisfies Formula 2 and Formula 3:

$$3\times([C]+[N])\leq([Sn]+[Sb]+[P]+[As]+[Se]+[Pb]+[Bi])\leq 15\times([C]+[N]) \quad \text{[Formula 2]}$$

$$([Sn]+[Sb])\geq[P]\geq([As]+[Se])\geq([Pb]+[Bi]) \quad \text{[Formula 3]}$$

here, [C], [N], [Sn], [Sb], [P], [As], [Se], [Pb], and [Bi] are contents (wt %) of C, N, Sn, Sb, P, As, Se, Pb, and Bi.

7. The method of claim 6, further comprising after the manufacturing of a hot-rolled steel sheet, performing hot-rolled steel sheet annealing on the hot-rolled steel sheet.

* * * * *